US006178553B1

(12) United States Patent
Bolton

(10) Patent No.: US 6,178,553 B1
(45) Date of Patent: Jan. 30, 2001

(54) BOXING GLOVE

(76) Inventor: Jesse F. Bolton, 353 Virginia Ave., Pittsburgh, PA (US) 15221

( * ) Notice: Under 35 U.S.C. 154(b), the term of this patent shall be extended for 0 days.

(21) Appl. No.: 09/523,122

(22) Filed: Mar. 10, 2000

(51) Int. Cl.[7] ..... A41D 13/08
(52) U.S. Cl. ..... 2/18
(58) Field of Search ..... 2/16, 18, 158, 2/161.1, 162, 917, 161.4, 159, 20; D29/116; 446/267

(56) References Cited

U.S. PATENT DOCUMENTS

| | | | | |
|---|---|---|---|---|
| Re. 28,480 | * | 7/1975 | Petrusek | 2/18 |
| Re. 32,287 | * | 11/1986 | Willis | 2/16 |
| 220,281 | * | 10/1879 | Glover | 2/18 |
| D. 273,343 | * | 4/1984 | Albert | D2/361 |
| D. 274,015 | * | 5/1984 | Golomb | D2/361 |
| D. 281,373 | * | 11/1985 | Golomb | D2/361 |
| 421,447 | * | 2/1890 | Stewart | 2/18 |
| 1,146,742 | * | 7/1915 | Stillman | 2/18 |
| 2,068,182 | * | 1/1937 | Jackson | 2/18 |
| 2,284,300 | * | 5/1942 | Portal | 2/18 |
| 2,556,759 | * | 6/1951 | Hilton | 2/18 |
| 3,755,820 | * | 9/1973 | Petrusek | 2/18 |
| 3,855,633 | * | 12/1974 | Rhee | 2/18 |
| 3,903,546 | * | 9/1975 | Rhee | 2/18 |
| 3,924,272 | * | 12/1975 | Allen et al. | 2/16 |
| 4,424,595 | * | 1/1984 | Albert | 2/18 |
| 4,425,668 | * | 1/1984 | Wen-Jen et al. | 2/18 |
| 4,457,023 | * | 7/1984 | Easterday | 2/18 |
| 4,603,439 | * | 8/1986 | Golomb | 2/18 |
| 4,667,343 | * | 5/1987 | Bettis | 2/18 |
| 5,458,564 | * | 10/1995 | Franzen | 2/16 |

* cited by examiner

*Primary Examiner*—John J. Calvert
*Assistant Examiner*—Gary L. Welch

(57) ABSTRACT

A boxing glove for preventing injuries to an opponent's eyes and thumb. The boxing glove includes a glove member having a main body, a thumb-receiving portion integrally extending along the length of a side of the main body, a wrist portion, a bottom end, an opening into the glove member through the bottom end, and a slit extending from the bottom end through the wrist portion on the palm side of the glove member; and also includes a first strap member securely attached in the interior of the main body and extending across the width of the main body and across the user's fingers; and further includes a string member used to lace the slit closed; and also includes padded members sewn to the main body to protect the user's hand; and also includes straps and hook and loop fasteners for securing the wrist portion about the user's wrist.

7 Claims, 2 Drawing Sheets

BOXING GLOVE

BACKGROUND OF THE INVENTION

1. Field of the Invention

The present invention relates to a glove used for boxing and more particularly pertains to a new boxing glove for preventing injuries to an opponent's eyes and thumb.

2. Description of the Prior Art

The use of a glove used for boxing is known in the prior art. More specifically, a glove used for boxing heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,284,300; 4,425,668; U.S. Pat. No. Des. 273,343; U.S. Pat. No. Des. 274,015; U.S. Pat. No. Des. 281,373; and U.S. Pat. No. 2,556,759.

While these devices fulfill their respective, particular objectives and requirements, the aforementioned patents do not disclose a new boxing glove. The inventive device includes a glove member having a main body, a thumb-receiving portion integrally extending along the length of a side of the main body, a wrist portion, a bottom end, an opening into the glove member through the bottom end, and a slit extending from the bottom end through the wrist portion on the palm side of the glove member; and also includes a first strap member securely attached in the interior of the main body and extending across the width of the main body and across the user's fingers; and further includes a string member used to lace the slit closed; and also includes padded members sewn to the main body to protect the user's hand; and also includes straps and hook and loop fasteners for securing the wrist portion about the user's wrist.

In these respects, the boxing glove according to the present invention substantially departs from the conventional concepts and designs of the prior art, and in so doing provides an apparatus primarily developed for the purpose of preventing injuries to an opponent's eyes and thumb.

SUMMARY OF THE INVENTION

In view of the foregoing disadvantages inherent in the known types of glove used for boxing now present in the prior art, the present invention provides a new boxing glove construction wherein the same can be utilized for preventing injuries to an opponent's eyes and thumb.

The general purpose of the present invention, which will be described subsequently in greater detail, is to provide a new boxing glove which has many of the advantages of the glove used for boxing mentioned heretofore and many novel features that result in a new boxing glove which is not anticipated, rendered obvious, suggested, or even implied by any of the prior art glove used for boxing, either alone or in any combination thereof.

To attain this, the present invention generally comprises a glove member having a main body, a thumb-receiving portion integrally extending along the length of a side of the main body, a wrist portion, a bottom end, an opening into the glove member through the bottom end, and a slit extending from the bottom end through the wrist portion on the palm side of the glove member; and also includes a first strap member securely attached in the interior of the main body and extending across the width of the main body and across the user's fingers; and further includes a string member used to lace the slit closed; and also includes padded members sewn to the main body to protect the user's hand; and also includes straps and hook and loop fasteners for securing the wrist portion about the user's wrist.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new boxing glove which has many of the advantages of the glove used for boxing mentioned heretofore and many novel features that result in a new boxing glove which is not anticipated, rendered obvious, suggested, or even implied by any of the prior art glove used for boxing, either alone or in any combination thereof.

It is another object of the present invention to provide a new boxing glove which may be easily and efficiently manufactured and marketed.

It is a further object of the present invention to provide a new boxing glove which is of a durable and reliable construction.

An even further object of the present invention is to provide a new boxing glove which is susceptible of a low cost of manufacture with regard to both materials and labor, and which accordingly is then susceptible of low prices of sale to the consuming public, thereby making such boxing glove economically available to the buying public.

Still yet another object of the present invention is to provide a new boxing glove which provides in the apparatuses and methods of the prior art some of the advantages thereof, while simultaneously overcoming some of the disadvantages normally associated therewith.

Still another object of the present invention is to provide a new boxing glove for preventing injuries to an opponent's eyes and thumb.

Yet another object of the present invention is to provide a new boxing glove which includes a glove member having a main body, a thumb-receiving portion integrally extending along the length of a side of the main body, a wrist portion, a bottom end, an opening into the glove member through the bottom end, and a slit extending from the bottom end through the wrist portion on the palm side of the glove member; and also includes a first strap member securely attached in the interior of the main body and extending across the width of the main body and across the user's fingers; and further includes a string member used to lace the slit closed; and also includes padded members sewn to the main body to protect the user's hand; and also includes straps and hook and loop fasteners for securing the wrist portion about the user's wrist.

Still yet another object of the present invention is to provide a new boxing glove that protects the user's hand much better than the prior art.

Even still another object of the present invention is to provide a new boxing glove that allows at least the same flexibility as the prior art.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
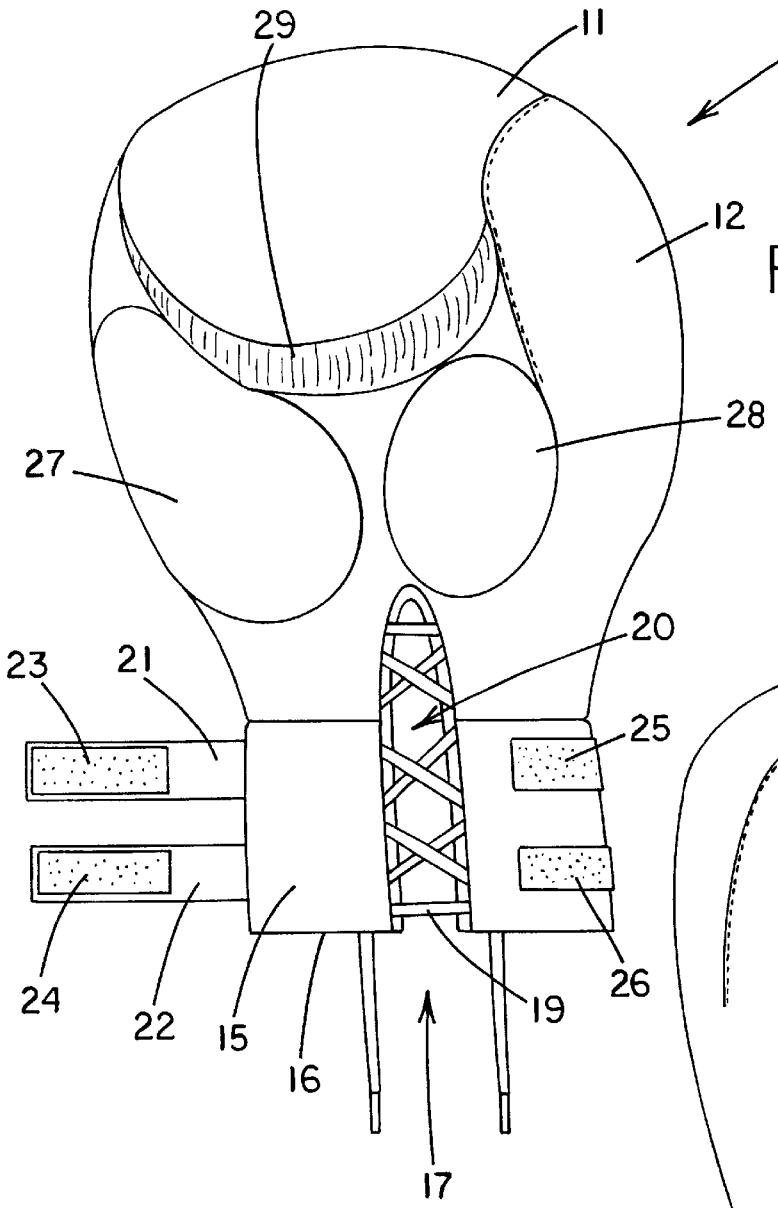
FIG. 1 is a front elevational view of a new boxing glove according to the present invention.
Figure 2:
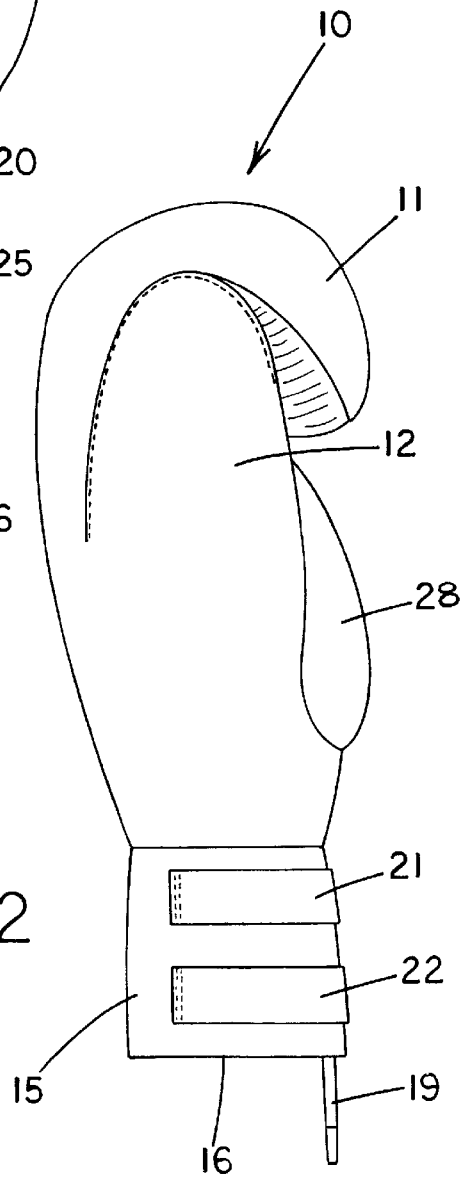
FIG. 2 is a side elevational view of the present invention.
Figure 3:
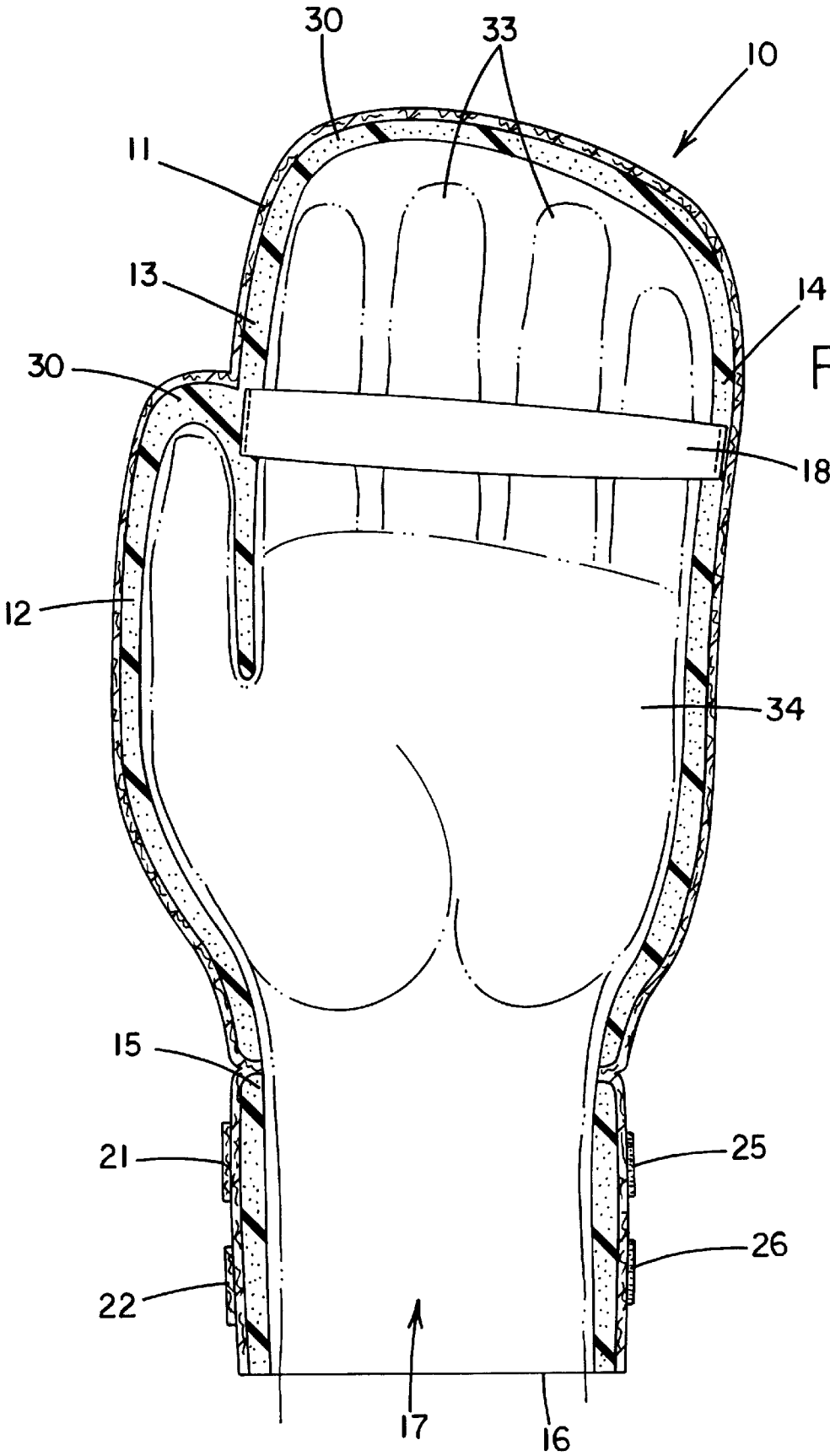
FIG. 3 is a cross-sectional view of the present invention.

With reference now to the drawings, and in particular to FIGS. 1 through 3 thereof, a new boxing glove embodying the principles and concepts of the present invention and generally designated by the reference numeral 10 will be described.

As best illustrated in FIGS. 1 through 3, the boxing glove 10 generally comprises a glove member including a main body 11 having sides 13,14, a thumb-receiving portion 12 being securely attached along a length thereof to the main body 11. The main body 11 has a wrist portion 15, a bottom end 16, an opening 17 in the bottom end 16 with the opening 17 being adapted to allow a user's hand 34 to be inserted into the main body 11 and the thumb-receiving portion 12. The main body 11 also has a slit 20 extending through the bottom end 16 and through the wrist portion 15 along a palm side of the main body 11. The thumb-receiving portion 12 is integrally extended along an exterior of one of the sides 13,14 of the main body 11. The wrist portion 15 has a length of approximately 5 inches. A first strap member 18 is securely disposed and sewn in the interior of the main body 11 and is adapted to extend across a users' fingers 33 inserted inside the glove member. The first strap member 18 has ends securely attached to an interior of the sides 13,14 of the main body 11 with the first strap member 18 being essentially disposed perpendicular to the thumb-receiving portion 12 and extending across a width of the main body 11 and being disposed near a top of the main body 11. A string member 19 is laced along either side of and across the slit 20 for closing the slit 20. A fastening means is securely attached and sewn to the wrist portion 15 and is adapted to secure the glove member about a user's wrist. The fastening means includes straps 21,22 having ends securely attached to an exterior of the wrist portion 15, and further includes a plurality of hook and loop fasteners 23–26 securely attached and sewn to an exterior of the wrist portion 15 and to the free ends of the straps 21,22 for securing the wrist portion 15 about the user's wrist. A plurality of padded members 27–30 are securely attached and sewn to the main body 11 for protecting the user's hand 34 during the use thereof. The padded members 27–30 include a first padded member securely attached to an interior of a palm side of the main body 11, a second padded member securely attached to an interior of a heel portion of the main body 11, a third padded member securely attached to an interior of the main body 11 at a base of the thumb-receiving portion 12, a fourth padded member securely attached to an exterior of the heel portion of the main body 11, a fifth padded member securely attached to an exterior of the main body 11 along a finger-tip portion thereof, and a sixth padded member securely attached to an exterior of the base of the thumb-receiving portion 12.

In use, the user inserts one's hand 34 into the glove member through the opening 17 in the bottom end 16 thereof, and tightens and ties the string member 19 together, and secures the fastening means about the wrist portion 15 with the strap member 18 extending across the user's fingers 33. The user is now ready to box with the boxing glove 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boxing glove comprising:

a glove member including a main body having sides, a thumb-receiving portion integrally extending along a length of one of said sides of said main body, said main body having a wrist portion, a bottom end, an opening in said bottom end, said opening being adapted to allow a user's hand to be inserted into said main body and said thumb-receiving portion, said main body also having a slit extending through said bottom end and through said wrist portion;

a first strap member securely disposed within said main body and being adapted to extend across a users' fingers inserted inside said glove member;

a string member laced along either side of and across said slit for closing said slit;

a fastening means securely attached to said wrist portion and being adapted to secure said glove member about a user's wrist;

a plurality of padded members securely attached to said main body for protecting the user's hand during the use thereof;

wherein said thumb-receiving portion is securely attached to an exterior of one of said sides of said main body;

wherein said first strap member has ends securely attached to an interior of said sides of said main body, said first strap member being essentially disposed perpendicular to said thumb-receiving portion and extending across a width of said main body;

wherein said strap member is disposed near a top of said main body;

wherein said fastening means includes straps having ends securely attached to an exterior of said wrist portion, and further includes a plurality of hook and loop fasteners securely attached to an exterior of said wrist portion and free ends of said straps for securing said wrist portion about the user's wrist; and wherein said padded members includes a first padded member securely attached to an interior of a palm side of said main body, a second padded member securely attached to an interior of a heel portion of said main body; a third padded member securely attached to an interior of said main body at a base of said thumb-receiving portion; a fourth padded member securely attached to an exterior of said heel portion of said main body; a fifth padded member securely attached to an exterior of said main body along a finger-tip portion thereof; and a sixth padded member securely attached to an exterior of said base of said thumb-receiving portion.

2. A boxing glove comprising:

a glove member including a main body having sides, a thumb-receiving portion being securely attached along a length thereof to said main body, said main body having a wrist portion, a bottom end, an opening in said bottom end, said opening being adapted to allow a user's hand to be inserted into said main body and said thumb-receiving portion, said main body also having a slit extending through said bottom end and through said wrist portion, said thumb-receiving portion being securely attached to an exterior of one of said sides of said main body, said wrist portion having a length of approximately 5 inches;

a first strap member securely disposed within said main body and being adapted to extend across a users' fingers inserted inside said glove member, said first strap member having ends securely attached to an interior of said sides of said main body, said first strap member being essentially disposed perpendicular to said thumb-receiving portion and extending across a width of said main body, said strap member being disposed near a top of said main body;

a string member laced along either side of and across said slit for closing said slit;

a fastening means securely attached to said wrist portion and being adapted to secure said glove member about a user's wrist, said fastening means including straps having ends securely attached to an exterior of said wrist portion, and further including a plurality of hook and loop fasteners securely attached to an exterior of said wrist portion and free ends of said straps for securing said wrist portion about the user's wrist; and a plurality of padded members securely attached to said main body for protecting the user's hand during the use thereof, said padded members including a first padded member securely attached to an interior of a palm side of said main body; a second padded member securely attached to an interior of a heel portion of said main body; a third padded member securely attached to an interior of said main body at a base of said thumb-receiving portion; a fourth padded member securely attached to an exterior of said heel portion of said main body; a fifth padded member securely attached to an exterior of said main body along a finger-tip portion thereof; and a sixth padded member securely attached to an exterior of said base of said thumb-receiving portion.

3. A boxing glove comprising:

a glove member including a main body having sides, a thumb-receiving portion integrally extending along a length of one of said sides of said main body, said main body having a wrist portion, a bottom end, an opening in said bottom end, said opening being adapted to allow a user's hand to be inserted into said main body and said thumb-receiving portion, said main body also having a slit extending through said bottom end and through said wrist portion;

a first strap member securely disposed within said main body and being adapted to extend across a users' fingers inserted inside said glove member;

a string member laced along either side of and across said slit for closing said slit;

a fastening means securely attached to said wrist portion and being adapted to secure said glove member about a user's wrist;

a plurality of padded members securely attached to said main body for protecting the user's hand during the use thereof; and wherein said padded members includes a first padded member securely attached to an interior of a palm side of said main body; a second padded member securely attached to an interior of a heel portion of said main body; a third padded member securely attached to an interior of said main body at a base of said thumb-receiving portion; a fourth padded member securely attached to an exterior of said heel portion of said main body; a fifth padded member securely attached to an exterior of said main body along a finger-tip portion thereof; and a sixth padded member securely attached to an exterior of said base of said thumb-receiving portion.

4. A boxing glove as described in claim 3, wherein said thumb-receiving portion is securely attached to an exterior of one of said sides of said main body.

5. A boxing glove as described in claim 3, wherein said first strap member has ends securely attached to an interior of said sides of said main body, said first strap member being essentially disposed perpendicular to said thumb-receiving portion and extending across a width of said main body.

6. A boxing glove as described in claim 3, wherein said strap member is disposed near a top of said main body.

7. A boxing glove as described in claim 3, wherein said fastening means includes straps having ends securely attached to an exterior of said wrist portion, and further includes a plurality of hook and loop fasteners securely attached to an exterior of said wrist portion and free ends of said straps for securing said wrist portion about the user's wrist.

* * * * *